US008018165B2

(12) United States Patent
Bredemeier

(10) Patent No.: US 8,018,165 B2
(45) Date of Patent: Sep. 13, 2011

(54) END-OF-LAMP LIFE DETECTION CIRCUIT

(75) Inventor: Peter Bredemeier, Pr. Oldendorf (DE)

(73) Assignee: International Rectifier Corporation, El Segundo, CA (US)

( * ) Notice: Subject to any disclaimer, the term of this patent is extended or adjusted under 35 U.S.C. 154(b) by 342 days.

(21) Appl. No.: 12/250,690

(22) Filed: Oct. 14, 2008

(65) Prior Publication Data

US 2010/0090608 A1 Apr. 15, 2010

(51) Int. Cl.
*H05B 37/00* (2006.01)

(52) U.S. Cl. ..... 315/119; 315/224; 315/307

(58) Field of Classification Search ..... 315/224, 315/291, 307, 308, 194, 119, 125
See application file for complete search history.

(56) References Cited

U.S. PATENT DOCUMENTS 7,486,029 B2 * 2/2009 Lee et al. ..... 315/224

* cited by examiner

*Primary Examiner* — David Hung Vu
(74) *Attorney, Agent, or Firm* — Farjami & Farjami LLP

(57) ABSTRACT

An end of life (EOL) detection circuit for a gas discharge lamp. The circuit includes a comparator for comparing an input voltage to first and second threshold voltages and providing an EOL signal; a sensing circuit for sensing a DC offset in the lamp-voltage during the EOL of the lamp; and a reference voltage setting circuit responsive to the DC offset including a reference diode for setting an adjustable reference voltage as said input voltage to the comparator.

20 Claims, 3 Drawing Sheets

END-OF-LAMP LIFE DETECTION CIRCUIT

BACKGROUND OF THE INVENTION

The present invention relates to End of Life detection and safety circuits and in particular to temperature independent End of Lamp Life safety circuits.

Low-pressure discharge lamps are driven by electronic ballasts that deliver preheating voltage for the lamp filaments, ignition voltage to ignite the lamps, and the lamp drive current in the steady state. Further, the electronic ballasts use a Power Factor Correction Stage to control the harmonic content of the input current. Moreover, the standards for electronic ballast manufacturing require inclusion of safety circuits for the detection of lamp End of Life (EOL).

FIG. 1 illustrates a prior art EOL safety circuit 10 having a window comparator that includes comparators 12 and 14. The comparator 12 receiving 3V reference voltage at its positive terminal and the comparator 14 receiving 1V reference voltage at its negative terminal, a negative terminal of the comparator 12 and a positive terminal of comparator 14 are coupled to a cathode terminal of a Zener diode DEOL1, and output terminals of the comparators 12 and 14 are coupled to provide an EOL signal. The EOL safety circuit 10 further includes resistors RL1, RL2 series coupled at a node V1, a capacitor CAV parallel coupled to the resistor RL2, a Zener diode DEOL2 having a cathode terminal coupled to a node V1 and an anode terminal coupled to an anode terminal of the Zener diode DEOL1. The circuit 10 also includes an amplifier 16 and a resistor R1.

At EOL the lamps develop a DC-Offset in the lamp-voltage. This offset is sensed by the resistors RL1, RL2, and the capacitor CAV. The circuit 10 detects EOL if voltage at node V1 increases or decreases to a level that Zener diodes DEOL2 or DEOL1 start conducting and the voltage on the input of the window comparator goes above 3V or below 1V. When the voltage goes outside this window, EOL NOT goes low, signifying end of life. The drawback of circuit 10 is that two Zener diodes are required for EOL detection. The Zener diodes have temperature dependency and a low accuracy at low currents.

SUMMARY OF THE INVENTION

It is an object of the present invention to provide an EOL circuit that is more accurate than the prior art circuit.

It is an object of the present invention to provide an EOL circuit that has little temperature dependency.

Provided is a circuit in an electronic ballast driving at least one low-pressure discharge lamp for providing safety during the End of Life (EOL) of the lamp. The circuit includes a comparator for comparing an input voltage to first and second threshold voltages and providing an EOL signal; a sensing circuit for sensing a DC offset in the lamp-voltage during the EOL of the lamp and a reference voltage setting circuit responsive to the DC offset including a reference diode for setting an adjustable reference voltage as said input voltage to the comparator.

Other features and advantages of the present invention will become apparent from the following description of the invention that refers to the accompanying drawings.

DETAILED DESCRIPTION OF EMBODIMENTS OF THE INVENTION

Figure 1:
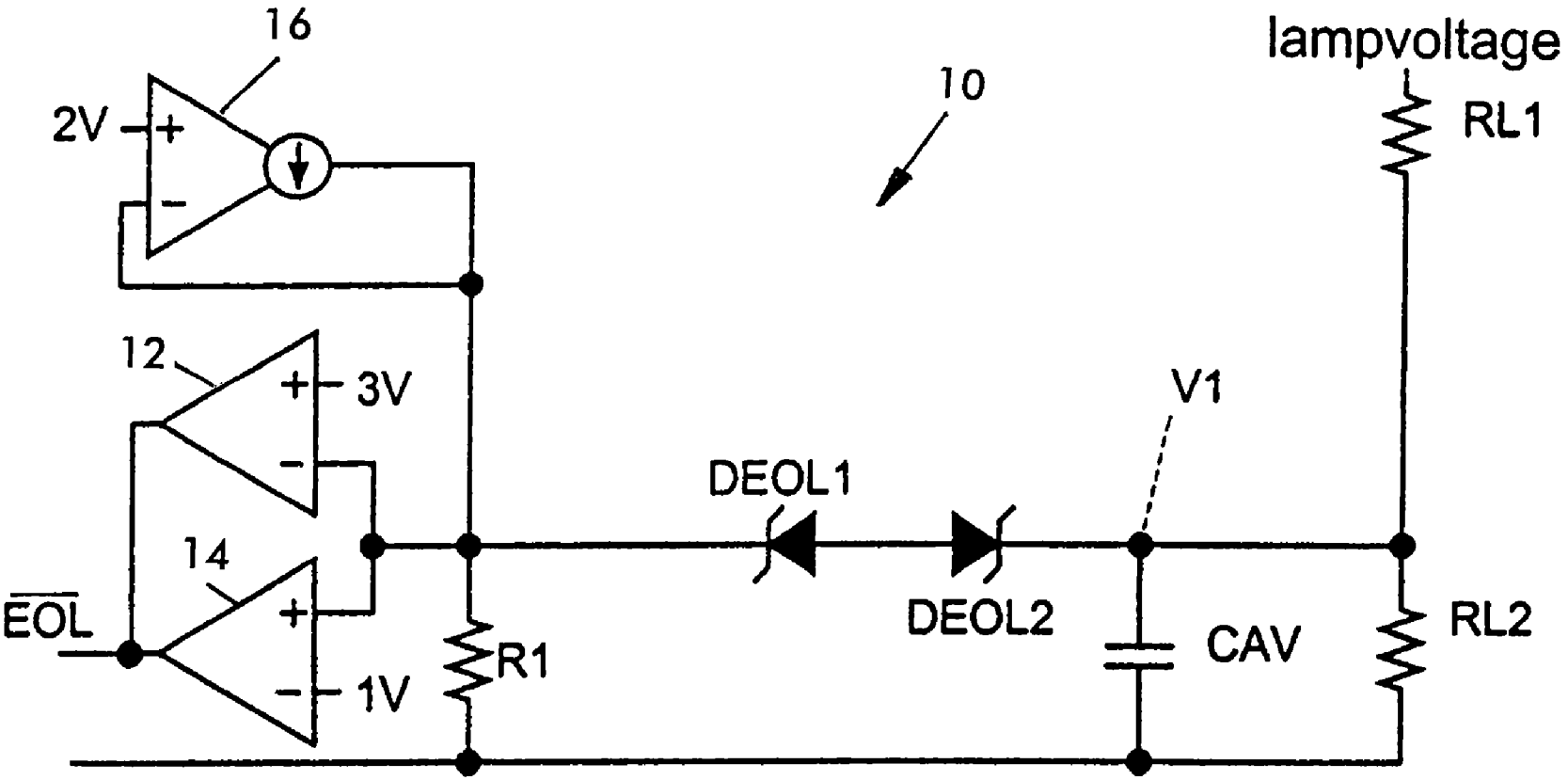
FIG. 1 PRIOR ART
FIG. 1 is a diagram of an EOL safety circuit of prior art, including two Zener diodes.
Figure 2:
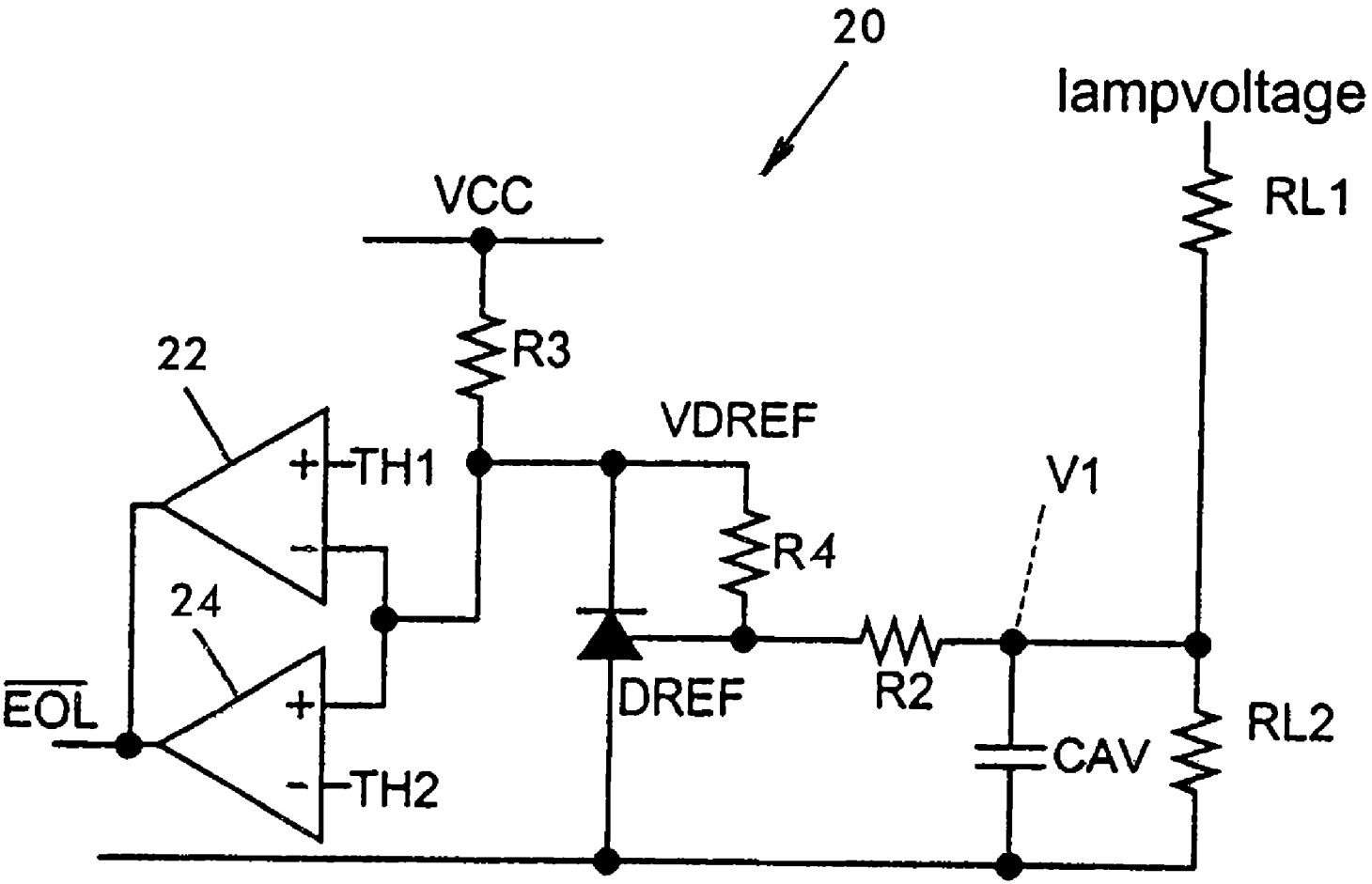
FIG. 2 is a diagram of an EOL safety circuit of the present invention, including a reference diode.

As illustrated in FIG. 2, an EOL safety circuit 20 of the present invention uses a reference diode DREF, instead of the two Zener diodes DEOL1 and DEOL2 (FIG. 1). A reference diode has a third input used to set the reference voltage setting and essentially acts as a variable voltage zener diode. As shown, circuit 20 includes a window comparator having comparators 22 and 24. The comparator 22 receives reference voltage TH1 at its positive terminal and the comparator 24 receives reference voltage TH2 at its negative terminal. The negative terminal of the comparator 22 and positive terminal of comparator 24 are coupled to the cathode terminal of the diode DREF. The output terminals of the comparators 22 and 24 are coupled to provide the inverse EOL signal. Similar to circuit 10, the EOL safety circuit 20 includes the resistors RL1, RL2 series coupled at the node V1 and a capacitor CAV parallel coupled to the resistor RL2. The circuit 20 further includes resistors R3 and R4 series coupled at the cathode terminal of the diode DREF and a resistor R2 coupled between the resistor R4 and the node V1.

Figure 3:
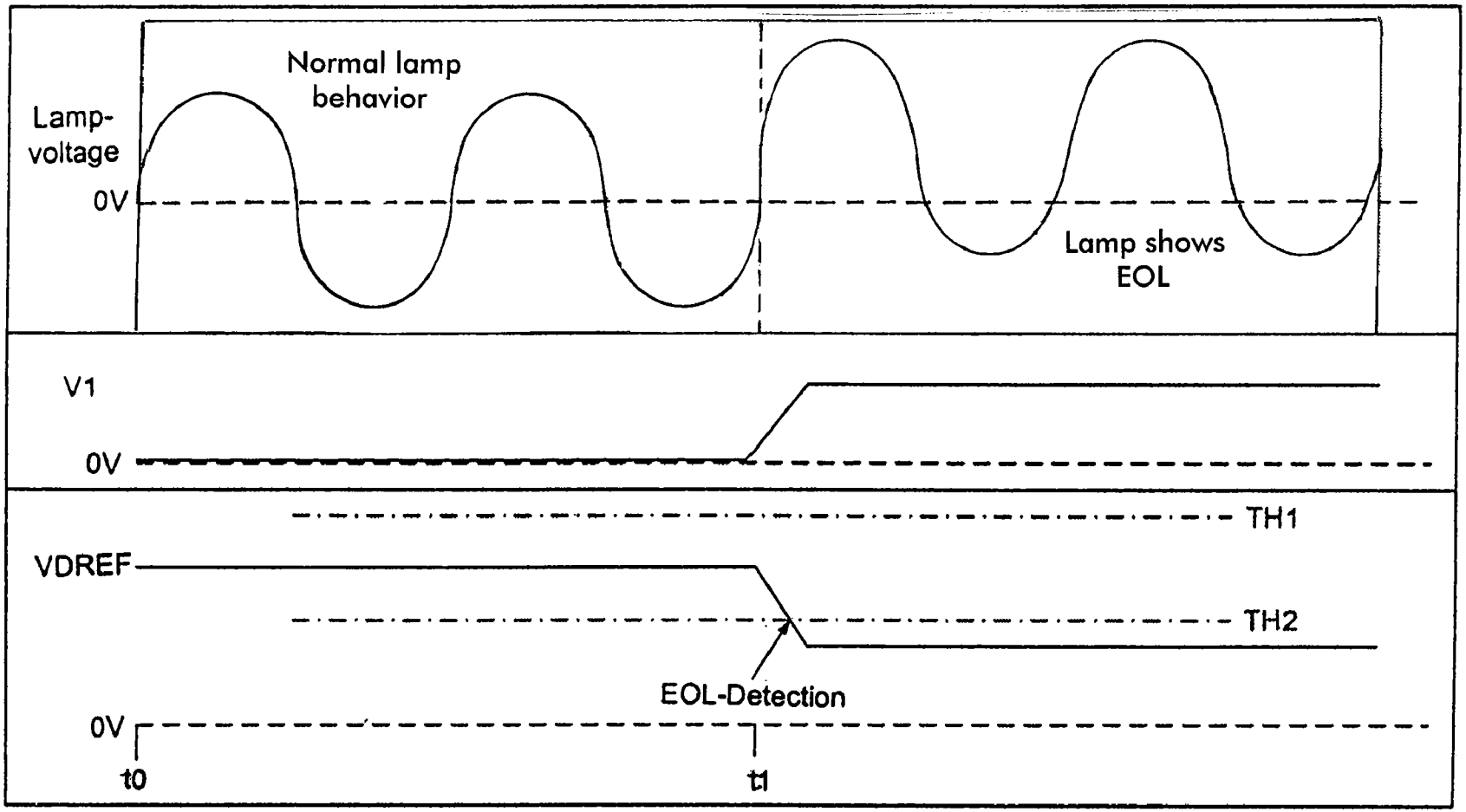
FIG. 3 is a timing diagram of the EOL safety circuit of FIG. 2 when the DC offset of the lamp at EOL is positive.

During normal lamp behavior, when the lamp has no DC-Offset (FIG. 3), the reference voltage provided by diode DREF is set by the resistors R4, R2 and RL2 in the middle of the threshold voltages TH1 and TH2. The resistor R3 delivers the regulation current for the diode DREF. As illustrated in the graph of FIG. 3, during the normal lamp behavior from time t0 to t1 the lamp shows no EOL behavior (no offset) and reference voltage VDREF is in the middle of the two voltage thresholds TH1 and TH2. Accordingly, the inverse of EOL is high, signifying a normal lamp.

From the time t1 the lamp begins to exhibit EOL behavior. The rectification behavior of the lamp-voltage gives a positive offset on the lamp voltage at V1 and the reference voltage VDREF decreases (in response to the adjustment input terminal of DREF) below the voltage threshold TH2, indicating EOL-detection. EOL (inverse) goes low. Alternatively, if the rectification behavior of the lamp gives a negative offset on the lamp-voltage the reference voltage VDREF will increase above the voltage threshold TH1 (and EOL inverse also goes low).

An advantage of the circuit is that it is very accurate and it has nearly no temperature dependency.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. An end of life (EOL) detection circuit for a gas discharge lamp comprising:

a comparator for comparing an input voltage to first and second threshold voltages and providing an EOL signal;

a sensing circuit for sensing a DC offset in the lamp-voltage during the EOL of the lamp; and a reference voltage setting circuit responsive to the DC offset including a reference diode for setting an adjustable reference voltage as said input voltage to the comparator;

wherein said reference diode includes an anode terminal, a cathode terminal, and a third terminal configured to receive an input for setting said adjustable reference voltage.

2. The circuit of claim 1, wherein the comparator comprises a window comparator.

3. The circuit of claim 2, wherein the window comparator includes first and second comparators having positive, negative, and output terminals, the first comparator receiving a first threshold voltage at its positive terminal and the second comparator receiving a second threshold voltage at its negative terminal, the negative terminal of the first comparator is connected to the positive terminal of the second comparator and is provided as the comparator input receiving the input voltage, and the output terminals of the first and second comparators are coupled to provide the EOL signal.

4. The circuit of claim 1, wherein the sensing circuit includes:

first and second resistors series coupled to receive a signal related to the lamp voltage and having a first node; and a capacitor coupled across the second resistor.

5. The circuit of claim 4, wherein the reference voltage setting circuit comprises:

a third resistor coupled to a voltage supply and said cathode terminal of the reference diode;

a fourth resistor coupled between the cathode terminal of the reference diode and an adjustment input terminal of the reference diode; and a fifth resistor coupled between the adjustment input terminal of the reference diode and the first node, the third resistor providing regulation current for the diode.

6. The circuit of claim 4, wherein the comparator detects EOL if voltage at the comparator input increases beyond the first threshold or decreases below the second threshold.

7. The circuit of claim 1, wherein during a normal lamp behavior the input voltage is set in the middle of the first and second threshold voltages.

8. The circuit of claim 1, wherein during EOL the input voltage decreases below the second threshold voltage or increases above the first threshold voltage.

9. The circuit of claim 1, wherein the sensing circuit includes a capacitor for filtering a signal related to the lamp voltage.

10. An end of life (EOL) safety circuit for a gas discharge lamp, said EOL safety circuit comprising:

first and second resistors series coupled at a common node and a capacitor parallel coupled to said second resistor;

a window comparator which receives an input voltage, compares it to first and second threshold voltages, and outputs an EOL signal;

a reference diode having a cathode terminal providing the input voltage to said window comparator, an anode terminal connected to said capacitor and said second resistor, and a third input terminal connected to said common node and operable to set an adjustable reference voltage at said cathode terminal based on a voltage at said common node.

11. The EOL safety circuit of claim 10, wherein said window comparator further comprises:

a first comparator receiving said first threshold voltage at a positive input; and a second comparator receiving said second threshold voltage at a negative input;

wherein respective outputs of said first and second comparators are connected together and wherein said cathode terminal of said reference diode is connected to a negative input of said first comparator and to a positive input of said second comparator.

12. The EOL safety circuit of claim 10, further comprising:

a third resistor coupled between a voltage supply and said cathode terminal of said reference diode;

a fourth resistor coupled between said cathode terminal of said reference diode and said third input terminal of said reference diode; and a fifth resistor coupled between said third input terminal of said reference diode and said common node.

13. The EOL safety circuit of claim 12, wherein said third resistor delivers a regulation current for said reference diode.

14. The EOL safety circuit of claim 10, wherein said EOL signal has a high value during normal lamp operation.

15. The EOL safety circuit of claim 10, wherein said first threshold voltage is greater than said second threshold voltage.

16. The EOL safety circuit of claim 10, wherein said adjustable reference voltage is set between said first and second threshold voltages during normal lamp operation.

17. The EOL safety circuit of claim 10, wherein said capacitor charges to a DC offset voltage of a lamp coupled to said first resistor, thereby setting said common node to said DC offset voltage.

18. The EOL safety circuit of claim 17, wherein a positive DC offset voltage at said common node causes said adjustable reference voltage to drop below said second threshold voltage.

19. The EOL safety circuit of claim 17, wherein a negative DC offset voltage at said common node causes said adjustable reference voltage to rise above said first threshold voltage.

20. The EOL safety circuit of claim 10, wherein said window comparator detects EOL if a voltage at said window comparator input rises above said first threshold voltage or drops below said second threshold voltage.

* * * * *